US006773229B1

(12) United States Patent
Itzel et al.

(10) Patent No.: US 6,773,229 B1
(45) Date of Patent: Aug. 10, 2004

(54) TURBINE NOZZLE HAVING ANGEL WING SEAL LANDS AND ASSOCIATED WELDING METHOD

(75) Inventors: Gary Michael Itzel, Simpsonville, SC (US); Robert Henry Devine, II, Klingswood, TX (US); John Alan Eastman, Simpsonville, SC (US); Charles Lewis Davis, III, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 4 days.

(21) Appl. No.: 10/387,834

(22) Filed: Mar. 14, 2003

(51) Int. Cl.[7] ..... F01D 1/02
(52) U.S. Cl. ..... 415/191; 415/208.1; 415/208.2
(58) Field of Search ..... 415/191, 192, 415/193, 194, 195, 208.1, 208.2, 211.1

(56) References Cited

U.S. PATENT DOCUMENTS 3,781,125 A * 12/1973 Rahaim et al. ..... 415/115
4,150,917 A * 4/1979 Silvestri, Jr. ..... 125/13.02
4,621,976 A * 11/1986 Marshall et al. ..... 415/191
5,526,789 A * 6/1996 Stein et al. ..... 123/432
5,743,708 A * 4/1998 Cunha et al. ..... 415/115
6,382,914 B1 5/2002 Tressler
6,390,774 B1 5/2002 Lewis et al.

* cited by examiner

*Primary Examiner*—Hoang Nguyen
(74) *Attorney, Agent, or Firm*—Nixon & Vanderhye P.C.

(57) ABSTRACT

A turbine nozzle is disclosed having a nozzle blade with an inner band, wherein the inner band has a region to receive a nozzle cover plate and at least one raised angel wing seal land section proximate a side of the recess; the nozzle cover plate is seated on the region of the inner band and the plate has a raised angel wing seal land section aligned with the at least one raised angel wing seal land section on the inner band, wherein the perimeter of the nozzle cover is welded to the inner band; a slot in the angel wing seal land is adjacent the perimeter of the cover plate, and the slot is filled with an insert after the cover plate is welded to the nozzle inner band.

8 Claims, 4 Drawing Sheets

TURBINE NOZZLE HAVING ANGEL WING SEAL LANDS AND ASSOCIATED WELDING METHOD

BACKGROUND OF THE INVENTION

This invention relates to nozzles for a turbine and particularly to a technique for attaching a cover to nozzle having angel wing seals.

Turbine nozzles in a gas turbine are typically attached to an inner cylindrical surface of a turbine casing. The nozzles form a radial array extending inward towards the turbine shaft. Each nozzle array is a stationary row arranged between rows of rotating turbine buckets. Hot combustion gases flow through the rows of nozzles and buckets to drive the rotation of the buckets. The rows of nozzles turn the hot combustion gases to align with the leading edges of the row of buckets that are immediately downstream of the nozzle row.

The hot gasses flow through an annular flow path across the nozzles and buckets. Gases are prevented by seals from flowing out of the flow path and into the wheel cavities. The seals include angel wings that are arms extending outward from the buckets towards the nozzles. The angel wings on a row of buckets form rings that overlap the edges of the cover plates on each of the nozzles in adjacent front and aft nozzle rows. The nozzle cover plates have an angel wing seal land that is overlapped by the angel wings on the buckets. The gap between the angel wings and the seal land is relatively small to minimize hot gas path flow leakage from the flow path to the wheel cavities.

During fabrication of each nozzle, cover plates are welded to the inner and outer bands of the nozzle castings to form a closed loop cooled nozzle. The nozzle casting consists of the nozzle blade and the inner and outer bands. The cover plates are typically attached to the nozzle casting by welding. Vertical welds are used to join the cover plates to the nozzle casting. The vertical weld of the cover plates to the nozzle casting increases the low-cycle fatigue (LCF) life of the nozzle casting to cover plate weld joint by allowing the joint to be placed in a region of low thermal gradient.

One source of difficulty in welding of the cover plates to a turbine nozzle casting has been the angel wing seal land that is typically a radial ridge across one end of the cover. The surface of the angel wing seal land is smooth and radial because it is to be in close proximity to the rotating angel wings of the buckets.

A continuous angel wing seal land is helpful to minimize ingestion of hot flow path air into the wheel space cavity. To have a continuous seal across the nozzle sidewall, the angel wing land would cross the cover plate to nozzle casting weld joint and interfere with the cover weld joint.

To avoid the angel wing seal lands and to provide for the vertical joint weld, compromises were made to the geometry of the angel wing seal land and of the joint between the machined cover and the cast nozzle. Further, to allow proper access to the joint of the welding head the length of angel wing seal land has been shortened and then land extenders are later added to the cover. Accordingly, there is a long felt need for welded joint geometries and techniques for welding a cover with angel wing seal lands to a nozzle casting.

SUMMARY OF THE INVENTION

This invention was developed to allow for a continuous angel wing seal land on the nozzle while permitting clearance for a vertical weld of the nozzle casting to the cover plate. In one embodiment, the invention is a turbine nozzle is disclosed having a nozzle blade with an inner band, wherein the inner band has a region to receive a nozzle cover plate and at least one raised angel wing seal land section proximate a side of the recess; the nozzle cover plate is seated on the region of the inner band and the plate has a raised angel wing seal land section aligned with the at least one raised angel wing seal land section on the inner band, wherein the perimeter of the nozzle cover is welded to the inner band; a slot in the angel wing seal land is adjacent the perimeter of the cover plate, and the slot is filled with an insert after the cover plate is welded to the nozzle inner band.

In a second embodiment the invention is a nozzle for a turbine comprising: a nozzle blade having an inner band, wherein said inner band has a recess to receive a nozzle cover plate and a pair of raised angel wing seal land sections proximate opposite sides of the recess; the nozzle cover plate being seated in the recess of the inner band and said plate further comprises a raised angel wing seal land section aligned with the pair of angel wing seal land sections on the inner band, wherein an perimeter of the nozzle cover is welded to a side wall of the recess in the inner band; a pair of slots in the angel wing seal land section on the cover plate, wherein the slot is adjacent the perimeter of the cover plate, and an insert in each of the slots, wherein said insert is substantially flush with a seal surface of the angel wing seal land section on the cover plate.

DETAILED DESCRIPTION OF THE INVENTION

Figure 1:
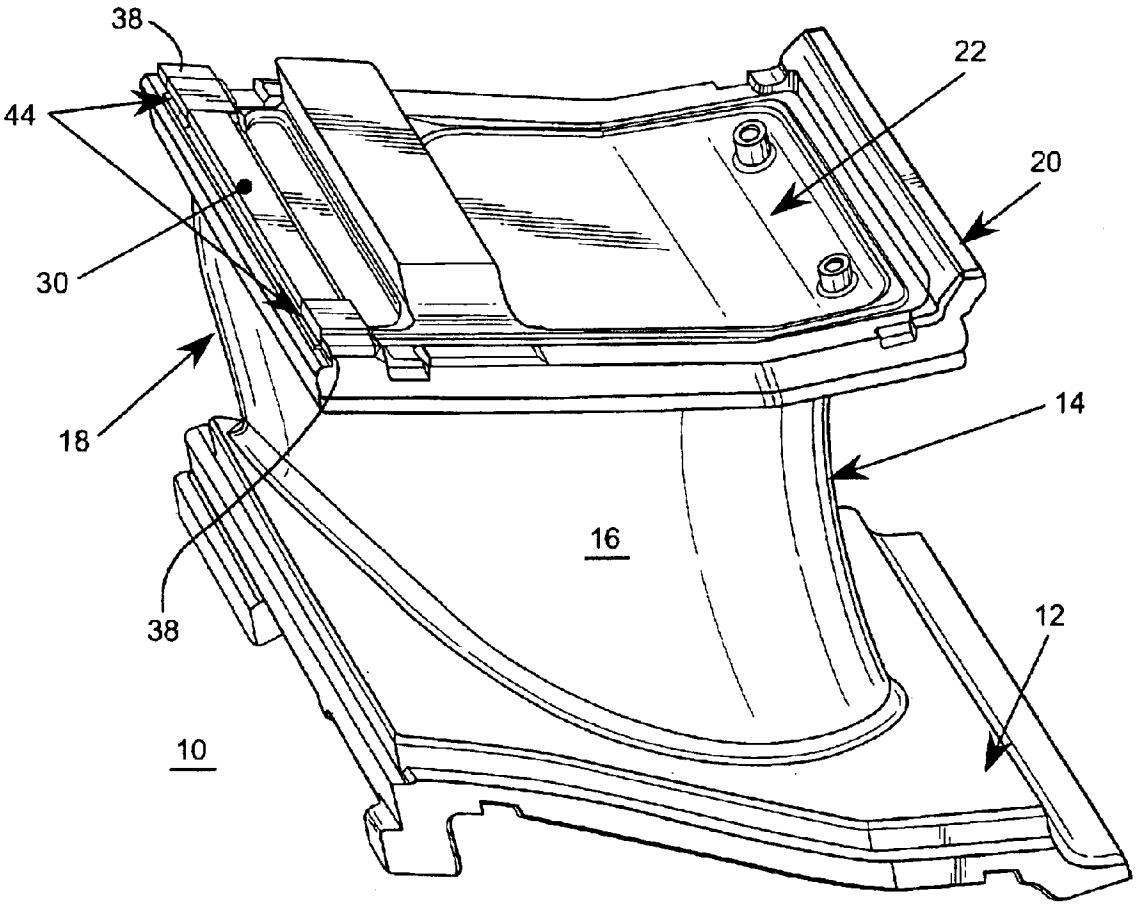
FIG. 1 is a perspective view of a turbine nozzle having a blade, cover, and an angel wing seal land.

FIG. 1 is a perspective view of a turbine nozzle 10. The nozzle is generally arranged in an array of stationary nozzles that are mounted on a turbine casing. The outer band 12 of the nozzle is mounted to an inner cylindrical surface of the casing. The nozzles are axially aligned with a annular stage of turbine bucket blades (not shown) The nozzles receive hot combustion gases along a leading edge 14 of the nozzle blade 16. The hot combustion gases may flow directly from a turbine combustor or flow from an upstream stage of rotating turbine buckets. Each row of nozzle blades 16 turn the flow of hot combustion gases so that the gases flow from the nozzle trailing edge 18 to another row of turbine buckets immediately downstream of the trailing edge 16 of the nozzle.

The nozzle blade 16 extends radially inward from the casing and is attached to an inner band 20 at the radial inward tip of the blade. The nozzle inner band forms an inner boundary of the combustion gas flow path through the nozzle. The outer band 12 forms the outer boundary of the flow path. The nozzle blade 16 extends across the flow path. The blade 16, inner band 20 and outer band 12 are generally formed by casting as a single metal or ceramic component.

Figure 2:
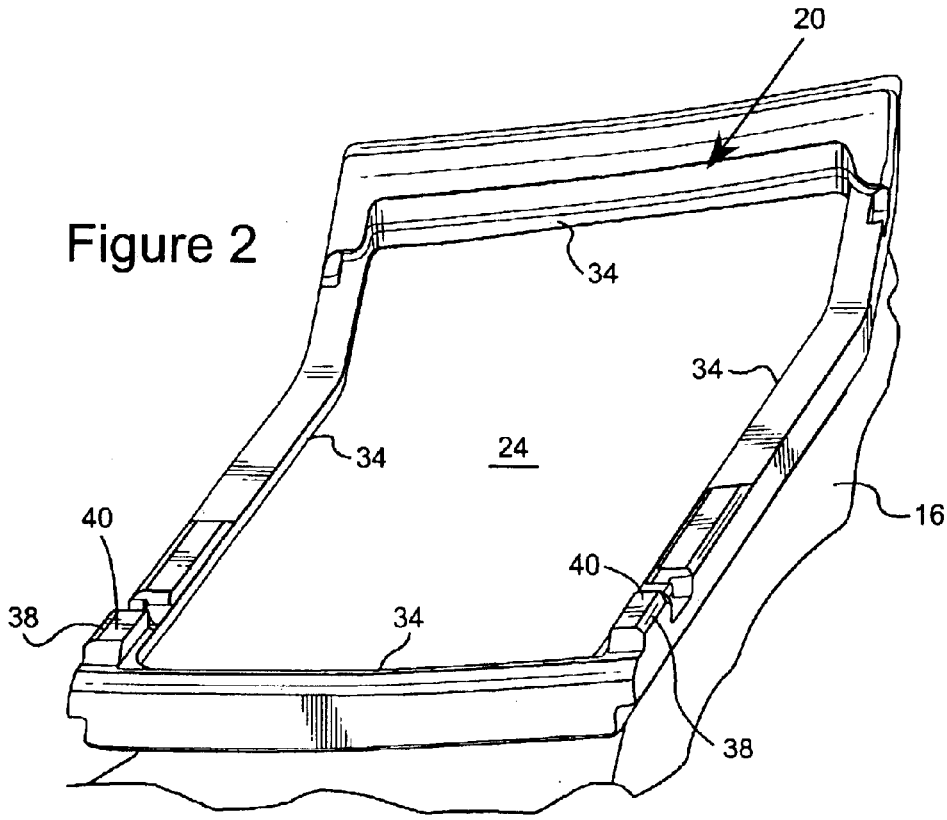
FIG. 2 is a perspective view of an upper surface of a nozzle inner bands.

As shown in FIG. 2, a recess 24 in an outer surface of the inner band 20 receives the cover plate 22. The cover plate 22 may be a single metal machined component or multiple components. The cover plate includes a rectangular plate section 26, a radial sealing ridge 28, and a portion 30 of the angel wing seal land.

Figure 3:
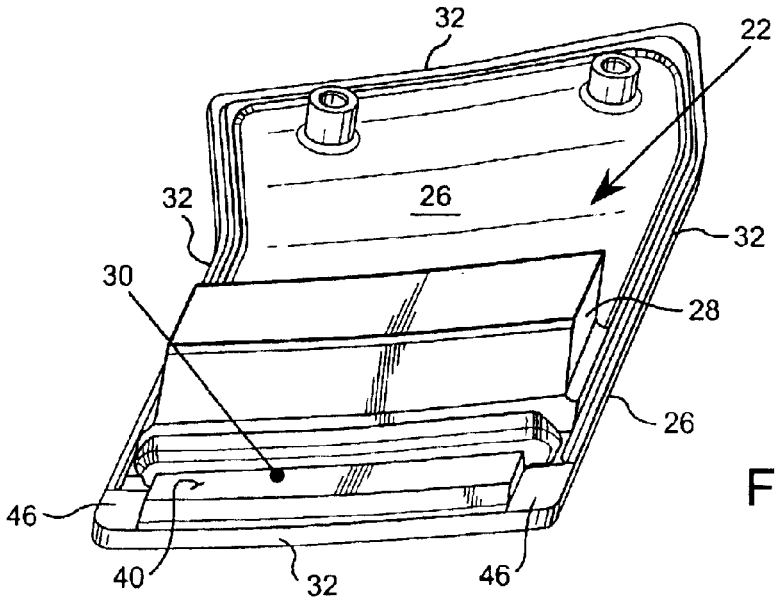
FIG. 3 is a perspective view of a cover.
Figure 4:
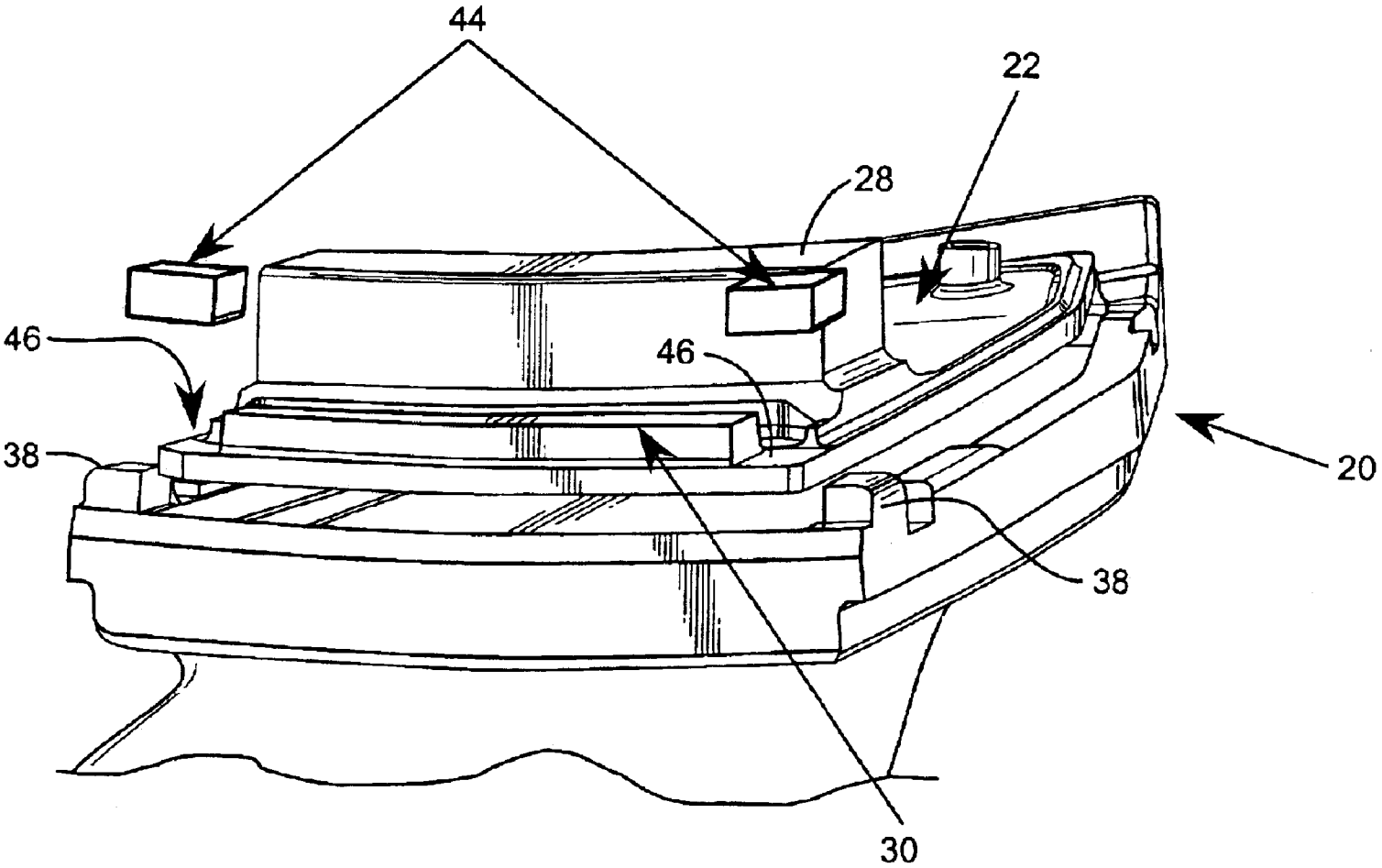
FIG. 4 is a close up exploded view of the cover, angel wing seal land and the inserts.
Figure 5:
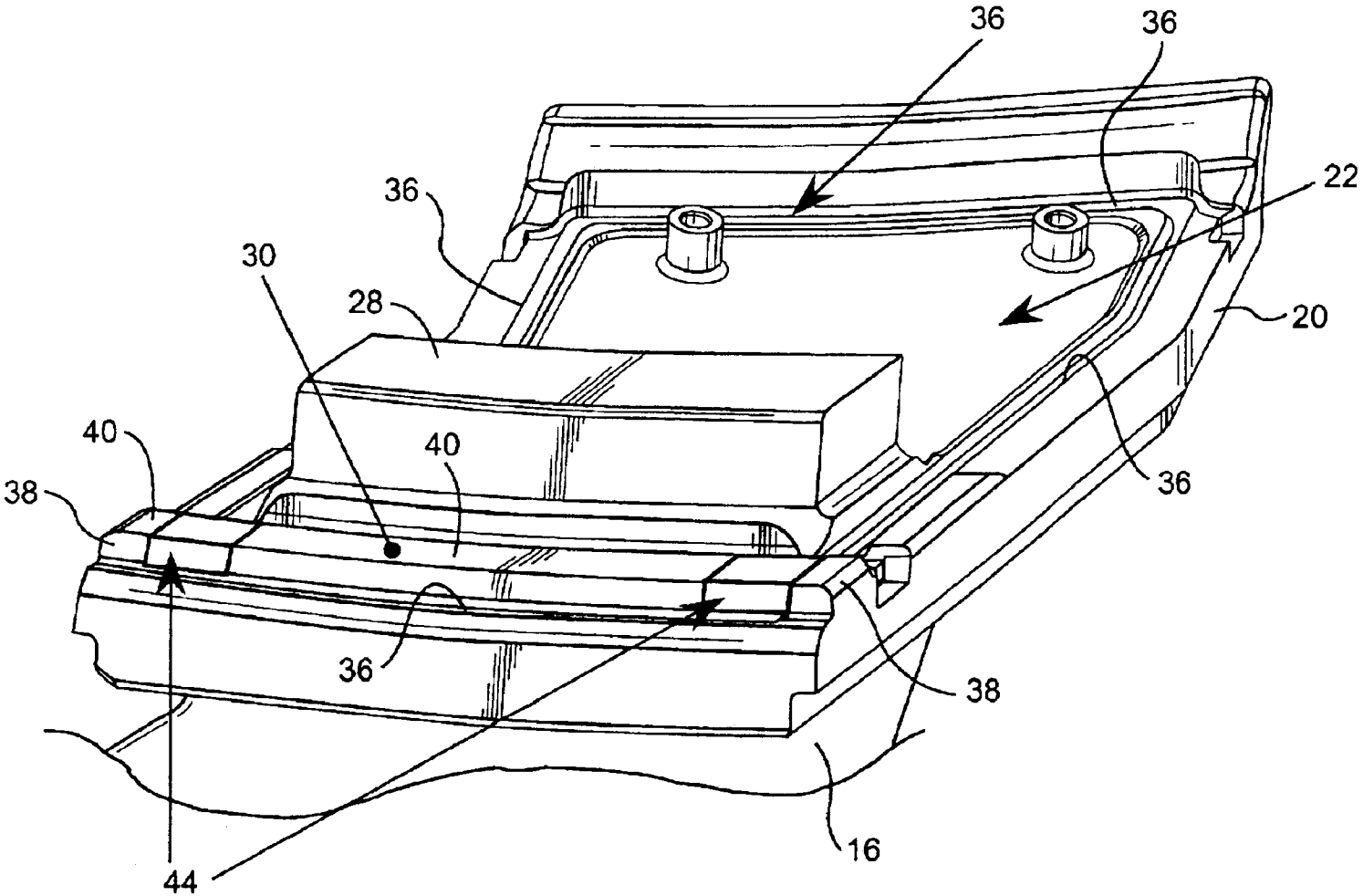
FIG. 5 is a close up view of an assembled nozzle casting, cover, and inserts.

As shown in FIGS. 3 and 4, the nozzle inner band 20 has a generally flat surface with a recess 24 to receive the cover pate 22 for the nozzle. The recess 24 is a surface on the nozzle inner band having a sidewall 34 which matches the outer perimeter 32 of the cover plate 22. Once the cover plate 22 has been seated within the inner band, a weld 36 is made around the entire perimeter of the cover plate. The weld 36 joins the perimeter 32 of the cover plate to the side wall 34 of the recess on the nozzle inner band. The weld joint 36 extends around the entire perimeter of the cover plate and securely attaches the cover to the inner band 20. The weld joint 36 satisfies the LCF requirements for the bond between the cover and inner band of the nozzle.

The angel wing seal land 30 of the cover plate 22 aligns with seal land portions 38 on the inner band 20. The angel wing seal land formed by the seal land portions 30, 38 on the cover plate and inner band extends 40 the width of the nozzle. The seal land has a flat upper surface 40 that is juxtaposed to the angel wings on the turbine buckets.

The upper surface 40 of the seal land is smooth and flat, except where slots 46 cuts through the land at opposite sides of the cover plate. The slots 46 are at opposite ends of the seal land portion 30 on the cover 22. Alternatively, the slots in the seal land section 38 on the nozzle inner band and adjacent the recess 24 for the cover plate. The angel wings sea land is slotted to allow the edge of the cover plate to be welded to the inner band.

The slots 46 allow the welding head to access the perimeter 32 of the cover plate, even in the region of the perimeter adjacent the seal land 30. The welding head is maneuvered around the perimeter of the cover plate to weld the cover to the nozzle inner band. The weld joint 36 does not disrupt the surface 40 of the seal land, because the joint does not extend upwards to the seal land surface. Rather, the weld joint 36 is in the slot 46 and the joint is below the surface 40 of the seal land.

The weld joint 36 formed between the cover plate 22 and nozzle inner band 20 is entirely out of the gas path and is not exposed to corrosive gases. Further, the surface 40 of the seal land is continuous across the width of the cover and provides a good seal with the angel wings of the buckets. By ensuring that the angel wing seal land is continuous across the width of the turbine nozzle, the seal between the nozzle and the adjacent turbine buckets is improved to prevent gas leakage.

The slots 46 in the seal land are filled by inserts 44 after the cover plate has been welded to the inner band. Once the cover plate 22 has been welded into the recess 24 of the nozzle inner band 20, rectangular inserts 44 are inserted into the slots 46 in the seal land. These metal inserts fill the slots 46 and are flush with the upper surface 40 of the seal land. The inserts are welded in place. The upper surface 40 of the seal land may be machine smooth and flat, after the inserts are welded in place.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle for a turbine comprising:

a nozzle blade having an inner band, wherein said inner band has a region to receive a nozzle cover plate and at least one raised angel wing seal land section proximate a side of the recess;

the nozzle cover plate being seated on the region of the inner band and said plate further comprises a raised angel wing seal land section aligned with the at least one raised angel wing seal land section on the inner band, wherein an perimeter of the nozzle cover is welded to the inner band, at least one slot in the angel wing seal land section on the cover plate or inner band, wherein the slot is adjacent the perimeter of the cover plate, and an insert in the slot substantially flush with a seal surface of the angel wing seal land sections.

2. A nozzle as in claim 1 wherein an entirety of the perimeter of the cover plate is welded to a side wall of the region.

3. A nozzle as in claim 1 wherein the at least one slot is a pair of slots adjacent opposite sides of the nozzle cover plate.

4. A nozzle as in claim 1 wherein the insert in a rectangular metallic insert sized to fill the slot.

5. A nozzle as in claim 1 wherein a weld joint between the arm and slot is below the insert.

6. A nozzle as in claim 1 wherein the slot is on the cover plate.

7. A nozzle as in claim 1 wherein the slot is on the inner band.

8. A nozzle for a turbine comprising:

a nozzle blade having an inner band, wherein said inner band has a recess to receive a nozzle cover plate and a pair of raised angel wing seal land sections proximate opposite sides of the recess;

the nozzle cover plate being seated in the recess of the inner band and said plate further comprises a raised angel wing seal land section aligned with the pair of angel wing seal land sections on the inner band, wherein an perimeter of the nozzle cover is welded to a side wall of the recess in the inner band;

a pair of slots in the angel wing seal land section on the cover plate, wherein the slot is adjacent the perimeter of the cover plate, and an insert in each of the slots, wherein said insert is substantially flush with a seal surface of the angel wing seal land section on the cover plate.

* * * * *